US005388336A

United States Patent [19]

Pomaville

[11] Patent Number: 5,388,336

[45] Date of Patent: Feb. 14, 1995

[54] BOW SIGHT

[76] Inventor: Louis F. Pomaville, 4030 Chilton St., Muskegon, Mich. 49441

[21] Appl. No.: 71,393

[22] Filed: Jun. 2, 1993

[51] Int. Cl.[6] ..... F41G 1/467

[52] U.S. Cl. ..... 33/265; 33/241; 124/87

[58] Field of Search ..... 33/265, 241; 124/87

[56] References Cited

U.S. PATENT DOCUMENTS

| | | | |
|---|---|---|---|
| 4,368,581 | 1/1983 | Tullos | 33/265 |
| 4,616,422 | 10/1986 | Gaddy | 33/265 |
| 4,643,160 | 2/1987 | Gray et al. | 33/265 |
| 4,711,036 | 12/1987 | Morris . | |
| 4,720,919 | 1/1988 | Saunders | 33/265 |
| 4,794,702 | 1/1989 | Martin | 33/265 |
| 4,796,364 | 1/1989 | Amacker . | |
| 4,884,347 | 12/1989 | Larson . | |
| 4,894,921 | 1/1990 | Barlow . | |
| 4,974,328 | 12/1990 | Lowry | 33/265 |
| 5,121,547 | 6/1992 | Littlejohn | 33/265 |
| 5,157,839 | 10/1992 | Beutler | 33/265 |
| 5,228,204 | 7/1993 | Khoshnood | 33/265 |
| 5,253,423 | 10/1993 | Sullivan, Jr. et al. | 33/265 |

OTHER PUBLICATIONS

Pp. 82–96, Discount Warehouse, Inc., Oct. 1993, and published by Bowhunters Warehouse, Inc., of Wellsville, Pa. 17365.

*Primary Examiner*—Thomas B. Will

*Attorney, Agent, or Firm*—Price, Heneveld, Cooper, DeWitt & Litton

[57] ABSTRACT

A sight system is provided including a peep adapted to attach to a bow string and a sight adapted to attach to a bow. The sight includes a sight bracket for attaching to the bow, an adjustable pendulum holder engaging the sight bracket and including a low friction bearing, a pendulum sight pivotally attached to the pendulum holder on the low friction bearing, the pendulum including a sight pin for accurate sighting on a target, and an elongate guard connected to the sight bracket and extending around the pendulum sight for protecting the pendulum sight. The guard can be aligned with the perimeter of the view through the peep and thus is useful for coarse and fine sighting on a target, which facilitates quick and error-free aiming of the bow, even under low light conditions.

31 Claims, 3 Drawing Sheets

BOW SIGHT

BACKGROUND OF THE INVENTION

The present invention relates generally to sights for hunting bows, and in particular to a pendulum bow sight constructed to facilitate aiming the bow from tree stands, particularly at dusk or when hunting, though the invention is not contemplated to be limited to only such use.

Bow sights potentially greatly improve the accuracy and consistency of an archer's shot by reducing the amount of guess-work required when aiming a bow. However, my experience is that present sights are inadequate since they are difficult to aim in low light and since they create too many opportunities for error in aiming while still requiring some guess-work. Initially, I note that many sights are difficult to quickly and accurately aim at dusk when low light levels make the sight pin and the target more difficult to see. This is because the hunter cannot see the bow or bow string for reference of aim for accuracy. Restated, just seeing the sight pin and target is not enough for an accurate shot in low light. Further, the chance of an error is magnified during the great excitement of a hunt such as when big game is involved. Some sights employ multiple pins which can be used for sighting, each pin representing a different distance. However, the archer must use guess-work when shooting at distances and elevations not represented by one of the pins. Also, I have found that it is not uncommon to select the wrong sight pin during the critical moment of aiming at the game. This problem is made worse by difficulty in seeing the sight pins, such as at dusk.

Pendulum sights have been developed to improve the accuracy of shooting from elevated places such as tree stands and the like. In pendulum sights, a pendulum including a sight pin is operably attached to a bow so that the sight pin swings to a corrected position as the bow is aimed. This allows the bow to be accurately aimed even at different angles and from different elevations. However, pendulum sights tend to include multiple parts which add complexity and cost to the sight. Further, pendulum sights are sensitive to the pendulum hanging up so that it does not swing freely. I note one pendulum sight in particular that I tested in which the pendulum had such a high center of gravity and such a high friction in the pivotal hole that at times the bow had to be moved about 13 degrees before the pendulum would move to a new position. Also, these sights are sometimes difficult to adjust and do not include the degrees of freedom of adjustment that may be desired. Still further, pendulum sights also have the aforementioned problem wherein sight pins can be difficult to see, particularly under low light conditions and when hunting. Thus, like other sights, they create potentials for error when aiming.

Thus, an improved bow sight solving the aforementioned problems is desired.

SUMMARY OF THE INVENTION

In one aspect, the present invention includes a sight system for a bow. The sight system includes a peep adapted to be attached to one of a bow and a bow string, and a sight adapted to be attached to the bow. The peep includes an orifice through which a target can be viewed, the orifice defining a view having a marginal edge when sighting through the orifice. The sight includes sighting means for accurately sighting on a target viewed through the orifice by centering the sighting means in the view, and further includes a guard forming a partial ring around the sighting means for protecting the sighting means, the guard defining an outer perimeter alignable with the marginal edge of the view for coarse sighting. This allows the bow to be quickly aimed by initially sighting on a target with the outer perimeter of the guard positioned proximate the marginal edge of the view, and then allows the bow to be more accurately aimed by centering the sighting means and the guard in the view and on the target.

In another aspect, the present invention includes a bow sight. The bow sight includes a sight bracket adapted to attach to a bow, and an adjustable pendulum holder engaging the sight bracket, the pendulum holder including a low friction bearing. A pendulum is pivotally attached to the pendulum holder on the low friction bearing, the pendulum including a sight pin for accurate sighting on a target. An elongate guard is connected to the sight bracket and extends around the pendulum and the sight pin for protecting same, the guard defining a geometric shape when viewed through a peep useful for coarse sighting on a target.

In another aspect, the present invention includes a bow sight comprising a sight bracket adapted to attach to a bow, a pendulum holder adjustably mounted to the sight bracket for adjustable movement in first and second orthogonal directions, and a pendulum sight pivotally attached to the pendulum holder. In a narrower aspect, the pendulum sight includes a sight pin adjustably mounted in the pendulum sight for adjustable movement in a third direction generally perpendicular to the first and second directions.

An object of the present invention is to provide a bow sight useable at low light levels, which can be reliably and accurately aimed with reduced tendency of error.

Another object of the present invention is to provide a pendulum bow sight having simplified construction, but which offers a high degree of adjustability in three directions.

Another object of the present invention is to provide a durable and long-lasting sight.

These and other features, advantages and objects of the present invention will be further understood and appreciated by those skilled in the art by reference to the following specification, claims and appended drawings.

DETAILED DESCRIPTION OF THE PREFERRED EMBODIMENT

Figure 1:
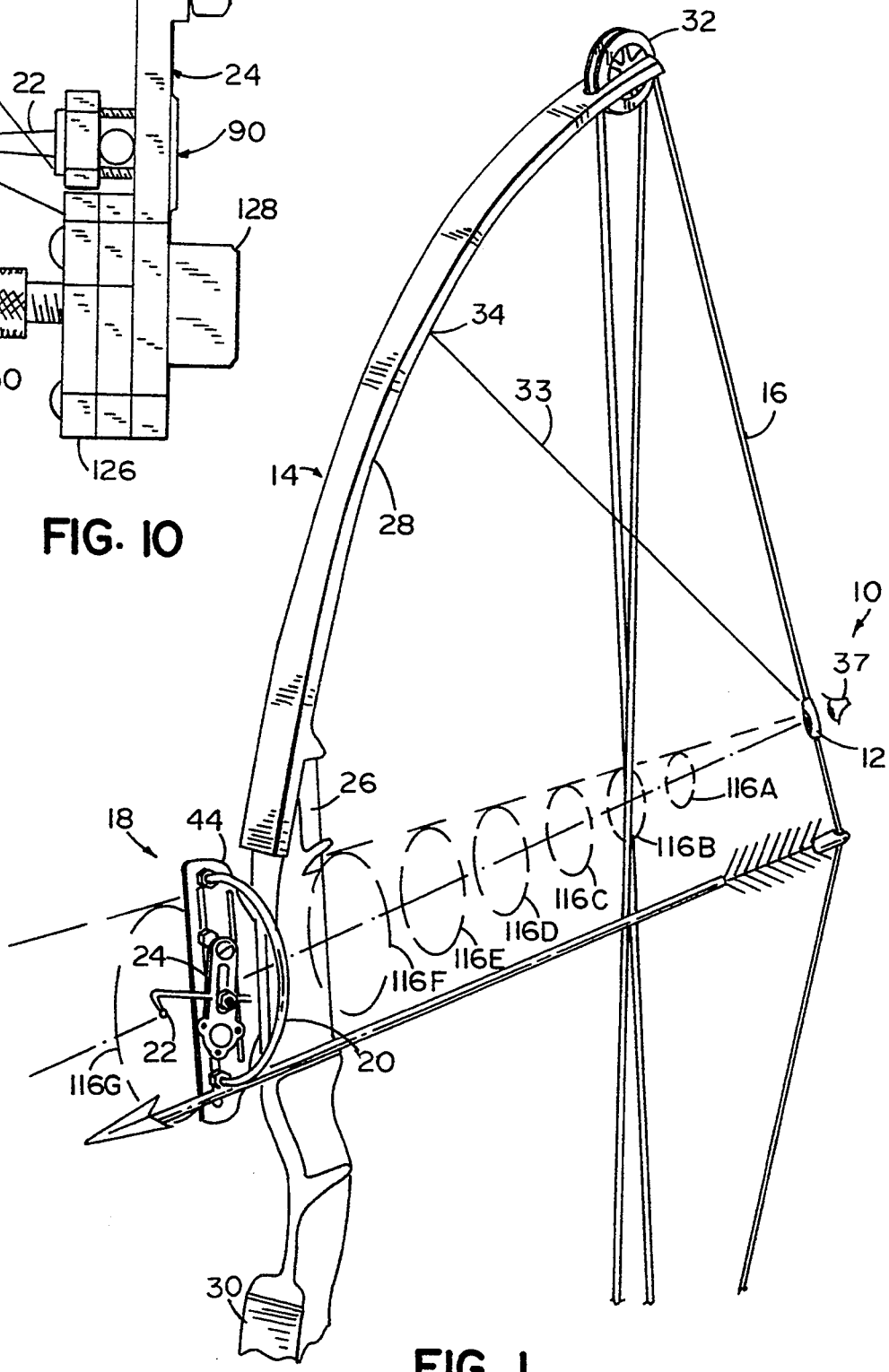
FIG. 1 is a partial perspective front view of a bow including a sight system embodying the present invention.

A sight system embodying the present invention is shown in FIG. 1 and is generally referred to by number 10. Sight system 10 includes a peep 12 adapted to be attached to a bow 14 such as on bow string 16, and further includes a sight 18 adapted to be attached to the bow 14. Sight 18 includes an arcuately shaped guard 20 that can be used for coarse sighting when viewing through peep 12, and further includes a sight pin 22 mounted on a pendulum 24 that can be used for fine sighting when viewing through peep 12. This arrangement provides for quick, accurate, and error-free aiming of bow 12 from elevated positions such as a tree stand, even under low light conditions and while under the excitement and pressures of hunting. Further, the sight 18 includes multiple adjustments for quick and accurate sighting-in of sight 18.

The present invention can be used on different styles of bows, but is believed to be particularly suited for a compound bow such as bow 14. Bow 14 includes a handle 26, and upper and lower limbs 28 and 30, respectively, that extend from handle 26. A wheel 32 is mounted for rotation on the end of upper limb 28 and a corresponding wheel (not shown) is mounted on the end of lower limb 30. Bow string 16 is threaded around the wheels and attached to the end of the opposite limb as is generally known in the art.

Figure 2:
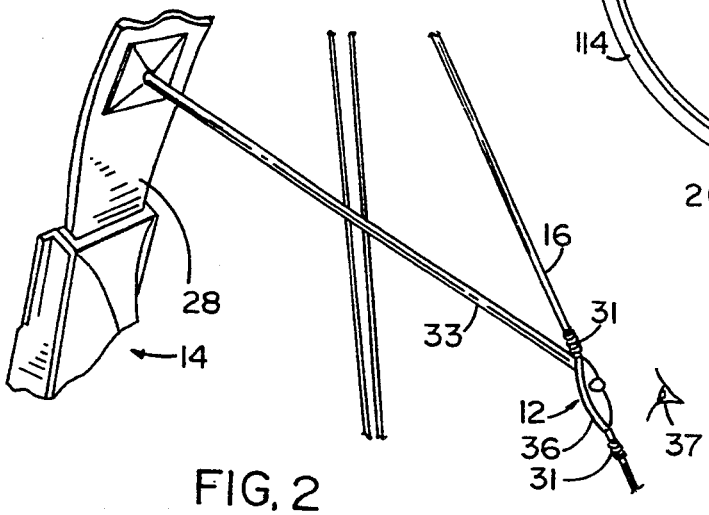
FIG. 2 is a partial perspective rear view of the bow and sight system shown in FIG. 1.
Figure 3:
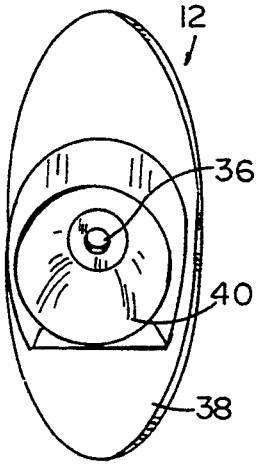
FIG. 3 is a rear view of the peep shown in FIG. 1.

It is contemplated that a number of different peeps can be successfully used with the sight 18 of the present invention. The illustrated peep 12 (FIG. 1) is securely mounted on bow string 16 by extending several threads of bow string 16 on each side of peep 12 and by securing the threads together above and below peep 12 by ties 31 (FIG. 2). A resilient alignment string 33 extends from peep 12 to a point 34 about half to two-thirds of the way up upper limb 28 from handle 26 where it is secured to upper limb 28. As bow string 16 is drawn, resilient alignment string 33 tensions and aligns an aperture 36 in peep 12 toward sighting pin 22 so that a person can see through peep 12 by aligning their eye 37 with aperture 36. Aperture 36 (FIG. 3) is optimally about 5/32" ID, although various sizes can be used as desired. The body 38 of peep 12 is generally ovular, and there is a funnel-shaped inlet surface 40 leading into aperture 36. A fluorescent dot is placed above inlet surface 40 or another visible surface on peep 12 is coated with fluorescent material so that peep 12 is more easily located under poor light conditions.

Sight 18 (FIGS. 4 and 5) includes a sight bracket 44 that is generally planar in shape. Sight bracket 44 includes an attachment flange 46 with slot 47 therein for receiving screws (not shown) to securely mount sight bracket 44 to bow 14 above handle 26. An enlarged front flange 48 extends forward of attachment flange 46 and includes two vertical slots 50 and 52 for mounting sight pins thereto. Pendulum 24 is operably mounted in front slot 50, and an optional stationary sight pin 54 is mounted in rear slot 52. Guard 20 is also mounted in front slot 50 protectingly around pendulum 24, as described below. It is noted that either sight pin 22 and 54 can be mounted in either slot 50 and 52 as long as the stationary pin 54 does not interfere with the movement of pendulum sight pin 22.

Stationary sight pin 54 (FIGS. 4 and 5) is a separate sight that can be sighted-in such as for shooting from the ground. Stationary sight pin 54 includes a threaded post 56 that extends through rear slot 52, and also includes a pointed tip 62 useful for sighting on a target or game. Nuts 58 and 60 are threaded onto post 56 on either side of sight bracket 44 and tightened to secure post 56 in a desired position. Washers (not shown) can be used in conjunction with nuts 58 and 60 if desired. The pointed tip 62 of sight pin 54 is vertically adjustable by vertically moving post 56 to a desired location within rear slot 52 before tightening nuts 58 and 60. The pointed tip 62 is horizontally adjustable from side-to-side by rotating nuts 58 and 60 in the same rotational direction so as to extend or retract post 56 in a direction perpendicular to sight bracket 44. A rubber sleeve 64 slipped onto post 56 prevents noise from pendulum 24 striking post 56.

Figure 4:
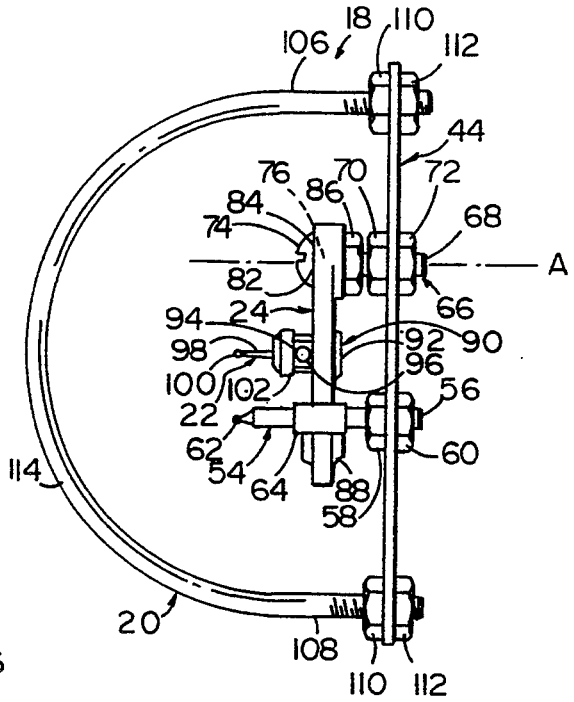
FIG. 4 is a rear view of the sight shown in FIG. 1.
Figure 5:
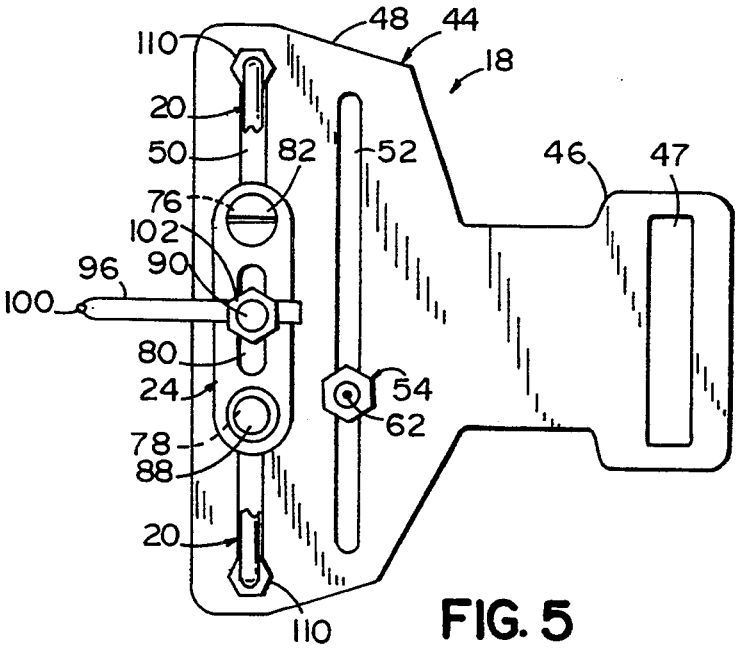
FIG. 5 is a side view of the sight shown in FIG. 1.

A pendulum holder or mounting post 66 is mounted in front slot 50 (FIGS. 4 and 5). Pendulum holder 66 includes a shaft with a threaded end 68 extended through front slot 50. A pair of nuts 70 and 72 are threaded onto pendulum holder 66 on either side of sight bracket 44. Washers (not shown) can be used in conjunction with nuts 70 and 72 if desired. By loosening nuts 70 and 72, pendulum holder 66 can be adjusted vertically. By loosening and rotating both nuts 70 and 72 in the same direction, pendulum holder 66 can be extended or retracted from sight bracket 44 to thus allow horizontal adjustment from side-to-side. Notably, pendulum holder 66 includes a slotted head 74 at its outer end engageable by a screwdriver to facilitate holding pendulum holder 44 in a specific position while tightening nuts 70 and 72.

Pendulum 24 is an elongate member about two inches long having an upper hole 76, a lower hole 78, and a slot 80 therebetween. Upper hole 76 is configured to slide over a low friction bearing 84 onto the end 82 of pendulum holder 66 adjacent slotted head 74. Bearing 84 is a reliable, high quality low friction bearing including ball bearings (not specifically shown) and is pressed into and positioned between end 82 and the material forming upper hole 76 so that the pendulum 24 is freely rotatable by gravity without hanging up. Notably, hanging up can be a real problem since the bow is often slowly aimed to keep from scaring the prey, thus the archer is never sure whether the pendulum has "broken loose" and moved to a true pendulum "bottom" position or not. Further, the archer may not even notice the problem. The present bearing 84 is intended to allow pendulum 24 to move even if the aim of the bow is only changed a fraction of a degree. An inner nut 86 is threaded onto pendulum holder 66 to retain pendulum 24 at end 82.

A weight 88 of about 0.5 ounces is press-fit into lower hole 78. The distance between holes 76 and 78, which is preferably at least about $1\frac{3}{8}$", in combination with weight 88 give pendulum 24 a low center of gravity relative to the axis of rotation A, which is centered on upper hole 76. This low center of gravity, relatively large lead weight 88, and low friction ball bearing 84 cause pendulum 24 to swing freely without hanging up.

A screw 90 with a head 92 is extended through slot 80 with head 92 abutting the inside surface of pendulum 24. The shaft of screw 90 is ground flat on opposing sides so that it fits non-rotatably within slot 80, but so that threads remain for receiving pin nut 102 as noted below. A transverse hole 94 extends through the shaft of screw 90, transverse hole 94 being positioned immediately adjacent pendulum 24 when screw 90 is fully inserted into slot 80. Transverse hole 94 is adapted to securely receive sight pin 22 as noted below.

Sight pin 22 is L-shaped having a long leg 96 of about ⅛" diameter and 2" length, and having a short leg 98 of about ½" to ⅝" length that is tapered down to the tip. Short leg 98 terminates in a point 100 useful as a sighting point. Sight pin 22 can be made of metal or plastic, but I have chosen polycarbonate because of its light weight, resiliency, strength, and durability. Point 100 is coated with fluorescent material to form a bead and to facilitate its use in low light conditions. Long leg 96 of sight pin 22 is extended a short distance into transverse hole 94, and a pin nut 102 is threaded onto screw 90 to clampingly retain sight pin 22 on pendulum 24. By adjusting long leg 96 fore-to-aft in transverse hole 94 and by adjusting pendulum holder 66 toward and away from the pendulum axis of rotation at bearing 84, the arcuate path of sighting point 100 of sight 18 can be optimally and accurately tuned to a particular bow and archer. Notably, there are a number of variables that must be adjusted to, such as bow strength, arrow weight and speed, and archer idiosyncrasies. The fore-to-aft adjustment and sight-to-axis length adjustment allows an archer to tune his bow to the largest range of accurate shooting possible.

Arcuately shaped guard 20 is substantially a U-shaped bolt including an arcuate portion 114 and parallel extending threaded ends 106 and 108. Ends 106 and 108 are positioned in sight bracket front slot 50 on either side of pendulum holder 66. Nuts 110 and 112 are threaded onto each of ends 106 and 108 on either side of sight bracket 44 to clampingly retain guard 20 on sight bracket 44. The arcuate portion 114 of guard 20 extends 180° around pendulum 24 protecting same and also forms a semi-circle with sight pin 22 located generally at the center of the circle defined thereby. Fluorescent paint is used to coat the portion of arcuate portion 114 that is visible through peep 12.

Figure 6:
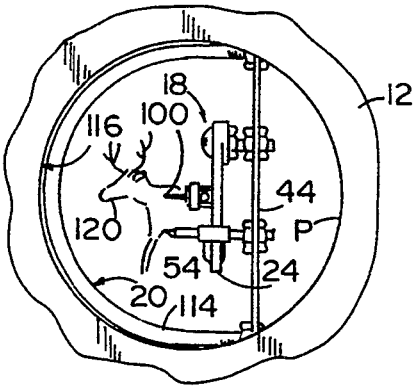
FIGS. 6–8 are views illustrating aiming the bow by use of the sight system.
Figure 7:
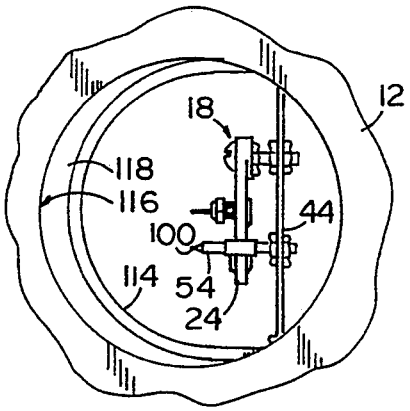
Figure 8:
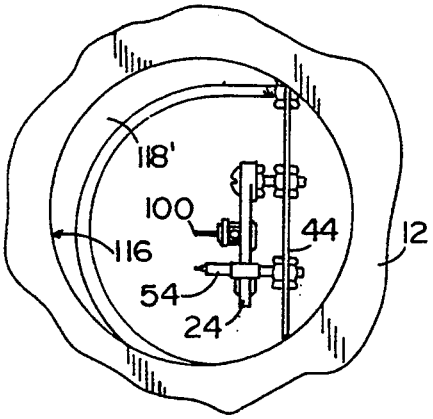

A circularly-shaped view 116 (indicated in FIG. 1 by numbers 116A–116G) is seen by peering through peep aperture 36. It is noted that the area to the right of dotted line 133 is normally blacked out by bow 14. For clarity, the bow 14 has been removed from the view in FIGS. 6–8. By aligning the arcuate portion 114 of guard 20 along the perimeter P of view 116 (FIG. 6), bow 14 can be coarsely but quickly and reliably aimed. FIG. 7 illustrates the bow 14 aimed too far to the right since arcuate portion 114 is spaced from the perimeter P by a crescent-shaped space or gap 118. FIG. 8 illustrates the bow 14 aimed low and to the right since, not only is there a crescent-shaped space 118', but the lower portion of guard 20 is cutoff from the view. Once guard 20 is properly aligned in view 116, the archer can focus sight pin point 100 on the target, such as game 120 (FIG. 6). In use I have found that an archer can simultaneously center the guard 20 in the view and the pendulum sight pin point 100 on the target for maximum accuracy while aiming. Notably, if stationary sight pin 54 is used it can be sighted in a similar manner.

During my experimentation, I have found that if the sight 18 is accidentally bent, such as in the region joining bracket attachment flange 46 and front flange 48, there is less of an impact on sighting than one would expect. My experience and testing show that the process of simultaneously aiming the bow 14 by aligning guard 20 in the view 116 and also aligning the sight has a lot to do with this phenomenon. Also, notably, the sight pin point 100 must be adjusted to the right if an archer is shooting to the right in order to correct for the misdirection. Contrastingly, the guard 20 must be adjusted to the left if an archer is shooting to the right in order to correct for the misdirection. These "opposing" adjustments further appear to positively affect the above noted phenomenon, and also facilitate accurate sighting-in of the bow.

Figure 10:
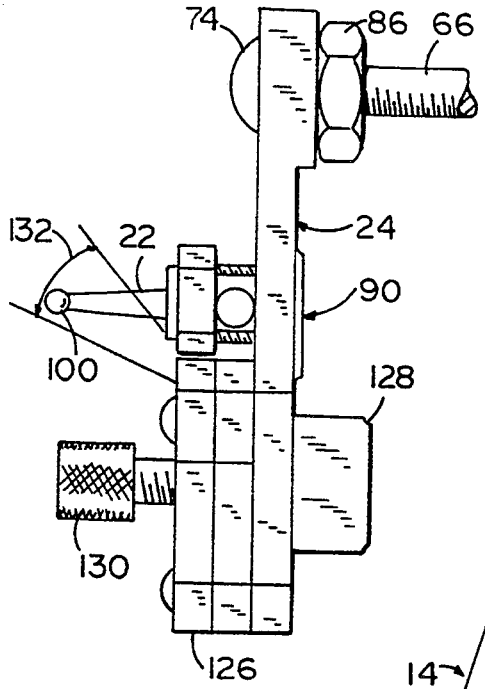
FIG. 10 is a front view of the modified pendulum sight shown in FIG. 9.
Figure 9:
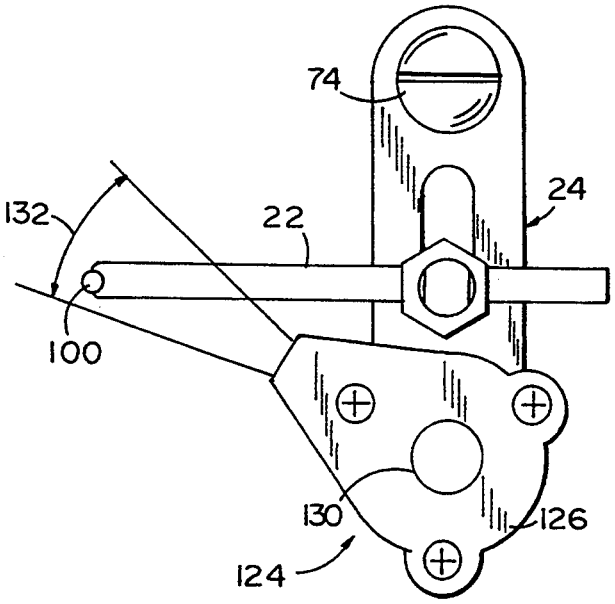
FIG. 9 is a side view of a modified pendulum sight embodying the present invention.

In one modification, weight 88 is removed and replaced with a light emitting device (LED) 124 (FIGS. 9 and 10). LED 124 includes a housing 126 that fits into the hole in pendulum 24, a battery compartment 128, and an on/off switch 130. In this modification, LED 124 is positioned to emit light generally upwardly as indicated by the arcuate span labelled 132 so as to illuminate the fluorescent coated sight pin point 100. The upward direction and also the laterally angled direction of the emitted light also prevents the light from being visible by game. Notably, LED 124 is contemplated to be of sufficient weight to replace weight 88 for efficient operation of pendulum 24. Also, it is contemplated that LED 124 only need illuminate the sight pin point 100 due to its small size, and not guard 20 due to the guard's larger size, although alternative embodiments are contemplated within the invention.

Notably, all components in sight 20 and the modification including LED 124 are reversible so that the same parts can be used for either a left handed or right handed archer. This further reduces the number of parts that need to be stocked for sight 20.

Thus, there is provided a sight and sight system that provides quick, reliable, and accurate aiming, but which is durable, long-lasting, and offers a high degree of adjustability. In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows.

1. A sight system for a bow having a bow string, comprising:

a peep adapted to be attached to the bow string, said peep including an orifice through which a target can be viewed, said orifice defining a view having an arcuately shaped marginal edge when sighted therethrough; and a pendulum sight adapted to be attached to the bow, said pendulum sight including sighting means for accurately sighting on a target viewed through said orifice by centering said sighting means in said view, and further including a guard forming a partial ring around said sighting means for protecting said sighting means, said guard having a predetermined size defining an arcuately shaped outer perimeter alignable with the arcuately shaped marginal edge of said view for coarse sighting, whereby the bow can be quickly and accurately aimed by initially sighting on a target with the outer perimeter of the guard aligned with the marginal edge of said view, and then can be more accurately aimed by centering the sighting means and the guard on the target.

2. A sight system as defined in claim 1 wherein said sight includes a sight bracket adapted for mounting to the bow, said sight bracket including a slot, said sight further including a pendulum holder adjustably attached to said sight bracket for adjustable movement in a first direction along said slot and in a second direction perpendicular to said first direction, and said sighting means includes a pendulum pivotally attached to said pendulum holder and further includes a sight pin adjustably attached to said pendulum for movement in a third direction different from said first and second directions, whereby said sight pin can be finely adjusted in said first, second and third directions for optimal sighting-in of the bow.

3. A sight system as defined in claim 2 wherein said guard includes a U-bolt having an arcuate portion.

4. A sight system as defined in claim 3 wherein said outer perimeter of said guard defines a semicircular shape around said sighting means.

5. A sight system as defined in claim 1 wherein said sight includes a pendulum holder adjustably mounted to the bow for movement in orthogonal directions and said sighting means includes a pendulum pivotally mounted to said pendulum holder.

6. A sight system as defined in claim 1 wherein said sight includes a sight bracket adapted for mounting to the bow and a pendulum holder adjustably mounted to said sight bracket including a ball bearing, and said sighting means includes a pendulum pivotally mounted to said pendulum holder on said ball bearing.

7. A sight system as defined in claim 1 wherein said sight includes two of said sighting means, one being a pendulum sight and the other being a stationary sight, the pendulum sight being useful for shooting from a tree stand and the stationary sight being useful for shooting from a position on the ground.

8. A sight system as defined in claim 1 wherein said sight includes a sight bracket adapted for mounting to the bow, said sight bracket including a slot to which said guard and said sighting means are mounted.

9. A sight system as defined in claim 1 wherein said sighting means includes a pendulum and a sight pin mounted on said pendulum to facilitate sighting-in the bow, said sight pin being adjustably mounted in said pendulum for adjustment generally toward and away from a target.

10. A sight system as defined in claim 1 wherein components of said sight are reversible so that said sight can be assembled for use by a right handed and a left handed archer.

11. A sight system as defined in claim 1 wherein said sight includes a sight bracket adapted for mounting to the bow, said sighting means includes a pendulum sight pivotally attached to said sight bracket, and said guard includes a U-shaped bolt attached to said sight bracket forming a protected area around said pendulum sight.

12. A sight system for a bow having a bow string, comprising:

a peep adapted to be attached to the bow string, said peep including an orifice through which a target can be viewed, said orifice defining a view having a marginal edge when sighted therethrough;

a sight adapted to be attached to the bow, said sight including sighting means for accurately sighting on a target viewed through said orifice by centering said sighting means in said view, and further including a guard forming a partial ring around said sighting means for protecting said sighting means, said guard including a U-bolt having an outer arcuate portion defining an outer semicircularly-shaped perimeter alignable with the marginal edge of said view for coarse sighting, said guard including a part which is visible through said peep and which is coated with fluorescent material for visibility, whereby the bow can be quickly and accurately aimed by initially sighting on a target with the outer perimeter of the guard aligned with the marginal edge of said view, and then can be more accurately aimed by centering the sighting means and the guard on the target;

said sight including a sight bracket adapted for mounting to the bow, said sight bracket including a slot said sight further including a pendulum holder adjustably attached to said sight bracket for adjustable movement in a first direction along said slot and in a second direction perpendicular to said first direction, and said sighting means including a pendulum pivotally attached to said pendulum holder and further including a sight pin adjustably attached to said pendulum for movement in a third direction different from said first and second directions, whereby said sight pin can be finely adjusted in said first, second and third directions for optimal sighting-in of the bow.

13. A sight system as defined in claim 12 wherein a part of said peep is coated with fluorescent material.

14. A sight system as defined in claim 13 wherein said sight pin has a fluorescent coated point thereon to facilitate quick aiming.

15. A sight system for a bow having a bow string, comprising:

a peep adapted to be attached to the bow string, said peep including an orifice through which a target can be viewed, said orifice defining a view having a marginal edge when sighted therethrough;

a sight adapted to be attached to the bow, said sight including sighting means for accurately sighting on a target viewed through said orifice: by centering said sighting means in said view, and further including a guard forming a partial ring around said sighting means for protecting said sighting means, said guard defining an outer perimeter alignable with the marginal edge of said view for coarse sighting, whereby the bow can be quickly and accurately aimed by initially sighting on a target with the outer perimeter of the guard aligned with the marginal edge of said view, and then can be more accurately aimed by centering the sighting means and the guard on the target; and said sight including a sight bracket and said sighting means including a pendulum pivotally attached to said sight bracket, said pendulum having a recess therein, and including a lighting means positioned in said recess for lighting said sighting means and for acting as a weight on said pendulum to cause said pendulum to pivot uniformly and smoothly as the bow is tilted.

16. A bow sight as defined in claim 15 wherein said lighting means emits light generally upwardly so that the light cannot be seen from a position below the bow sight.

17. A sight system for a bow comprising:

a sight bracket adapted to attach to a bow;

an adjustable pendulum holder engaging said sight bracket, said pendulum holder including a low friction bearing;

a pendulum pivotally attached to said pendulum holder on said low friction bearing, said pendulum including a sight pin for accurate sighting on a target, said pendulum being adjustable on said pendulum holder in a first direction perpendicular to said axis and in a second direction parallel said axis, said sight pill being adjustable on said pendulum in a horizontal third direction and a vertical fourth direction; and an elongate guard connected to the sight bracket and extending around said pendulum and said sight pin for protecting same, said guard defining a geometric arcuate outer shape that, when viewed through a peep, is useful for coarse sighting on a target.

18. A system as defined in claim 17 wherein said guard includes a U-bolt.

19. A sight system as defined in claim 17 wherein said pendulum defines an axis of rotation, and said sight pin is adjustably mounted in said pendulum holder for movement toward and away from the axis of rotation.

20. A sight system as defined in claim 17 wherein said sight bracket includes a slot, said pendulum holder is adjustably attached to said sight bracket in said slot for adjustable movement in a first direction along said slot and adjustably mounted in said slot for movement in a second direction perpendicular to said first direction, and said sight pin is adjustably attached to said pendulum for movement in a third direction different from said first and second directions, whereby said sight pin can be finely adjusted in three directions for optimal sighting-in of the bow.

21. A sight as defined in claim 17 wherein said low friction bearing includes ball bearings.

22. A sight system comprising:

a sight bracket adapted to attach to a bow;

an adjustable pendulum holder engaging said sight bracket, said pendulum holder including a low friction bearing;

a pendulum pivotally attached to said pendulum holder on said low friction bearing, said pendulum including a sight pin for accurate sighting on a target; and an elongate guard connected to the sight bracket and extending around said pendulum and said sight pin for protecting same, said guard including a U-bolt defining a geometric arcuate outer shape having a part that is visible through a peep on the bow and, when viewed through the peep is useful for coarse sighting on a target, said part of said guard being coated with fluorescent material.

23. A sight system as defined in claim 22 wherein said sight bracket, said adjustable pendulum holder, said pendulum and said elongate guard are reversible so that the same parts can be assembled in a reversed orientation and thus can be used by a right handed archer and a left handed archer.

24. A sight system as defined in claim 22 wherein the part of said guard that is coated with fluorescent material is only that part visible by a hunter holding and aiming the bow.

25. A sight system comprising:

a sight bracket adapted to attach to a bow;

an adjustable pendulum holder engaging said sight bracket, said pendulum holder including a low friction bearing;

a pendulum pivotally attached to said pendulum holder on said low friction bearing, said pendulum including a sight pin for accurate sighting on a target;

an elongate guard connected to the sight bracket and extending around said pendulum and said sight pin for protecting same, said guard defining a geometric shape that, when viewed through a peep on the bow, is useful for coarse sighting on a target; and said pendulum having a recess therein, and including a lighting means positioned in said recess for lighting said sight pin and for acting as a weight on said pendulum to cause said pendulum to pivot uniformly and smoothly as the bow is moved.

26. A bow sight comprising:

a sight bracket adapted to attach to a bow, said sight bracket including a first slot;

a pendulum holder including a shaft with a threaded end and an opposing end, said threaded end being adjustably mounted to said first slot of said sight bracket for adjustable movement in first and second orthogonal directions, said first orthogonal direction being along said first slot; and a pendulum sight pivotally attached to said pendulum holder and defining an axis of rotation, said pendulum sight including a pendulum member with a second slot and a sight pin adjustably mounted in said second slot to said pendulum member, said sight pin being adjustable vertically toward and away from said axis and being adjustable horizontally toward and away from said axis.

27. A bow sight as defined in claim 26 including a guard attached to said sight bracket in said first slot independent of said pendulum holder, said guard being positioned around said pendulum sight for protecting same.

28. A bow sight as defined in claim 27 wherein said guard is a U-bolt having an arcuate shape useful for course sighting on a target.

29. A sight system as defined in claim 26 wherein said pendulum sight includes a locking means for adjustably securing said sight pin in said second slot so that said sight pin is horizontally adjustable in said locking means, and so that said locking means is vertically adjustable along said second slot.

30. A method of sighting a bow including:

providing a bow, a pendulum sight attached to the bow, a peep also attached to the bow for viewing said pendulum sight, and a guard positioned around said pendulum sight for protecting the pendulum sight, the guard being elongate and including an arcuately shaped portion defining an outer and an inner perimeter, the peep defining a view having a marginal edge;

coarsely aiming the bow by aligning the outer perimeter of the guard with the marginal edge of the view with a target visibly located within the guard inner perimeter; and finely aiming the bow by positioning the pendulum sight on the target.

31. A sight system for a bow including a bow string, comprising:

a peep adapted for connection to the bow string, said peep defining a view including a marginal edge when a hunter looks through said peep;

a sight bracket adapted for connection to the bow;

a sight operably attached to said sight bracket; and a guard attached to said sight bracket, said guard including an arcuately shaped section having a side facing said peep, said side being visible through said peep and being covered with a fluorescent material, the other side of said guard not visible through the peep having a non-fluorescent surface, whereby said fluorescent material can be seen through said peep and aligned with the marginal edge of the view so that it assists in aiming at game but so that it cannot be seen by the game.

* * * * *